US010883496B2

(12) United States Patent
He et al.

(10) Patent No.: US 10,883,496 B2
(45) Date of Patent: Jan. 5, 2021

(54) METHOD FOR MODIFYING PERFORMANCE OF ROTOR PROFILE BY ADJUSTING MESHING LINE SEGMENTS

(71) Applicant: Jiangnan University, Wuxi (CN)

(72) Inventors: Xueming He, Wuxi (CN); Guojiang Shi, Wuxi (CN); Jiachuan Yu, Wuxi (CN); Ji Long, Wuxi (CN); Hainan Huang, Wuxi (CN)

(73) Assignee: Jiangnan University, Wuxi (CN)

( * ) Notice: Subject to any disclaimer, the term of this patent is extended or adjusted under 35 U.S.C. 154(b) by 130 days.

(21) Appl. No.: 16/234,914

(22) Filed: Dec. 28, 2018

(65) Prior Publication Data

US 2019/0186487 A1 Jun. 20, 2019

Related U.S. Application Data

(63) Continuation of application No. PCT/CN2017/119422, filed on Dec. 28, 2017.

(30) Foreign Application Priority Data

Dec. 19, 2017 (CN) ..... 2017 1 1371154

(51) Int. Cl.
*F04C 18/16* (2006.01)
*F04C 2/16* (2006.01)
(Continued)

(52) U.S. Cl.
CPC ..... *F04C 2/165* (2013.01); *F04C 18/084* (2013.01); *F04C 18/16* (2013.01); *F04C 18/165* (2013.01);
(Continued)

(58) Field of Classification Search
CPC ..... F04C 18/165; F04C 18/16; F04C 2/165; F04C 18/084; F04C 2/082; F01C 1/084
(Continued)

(56) References Cited

U.S. PATENT DOCUMENTS

2007/0273688 A1* 11/2007 Chen ..... G06T 17/20 345/420
2011/0020162 A1 1/2011 Izawa et al.

FOREIGN PATENT DOCUMENTS

CN 102352846 A 2/2012
CN 102828954 A 12/2012
(Continued)

OTHER PUBLICATIONS

Xueming He et al., Design and Numerical Simulation for Double-Screw Compressor Rotor Profile, Journal of Mechanical Strength, China, Dec. 31, 2016, No. 2, vol. 38, ISSN:1001-966, line 8 of left column of p. 289-line 39 of right column of p. 292.

*Primary Examiner* — Deming Wan
(74) *Attorney, Agent, or Firm* — IPro, PLLC; Na Xu

(57) ABSTRACT

The present disclosure provides a method for modifying performance of a rotor profile by adjusting meshing line segments, including the following steps: step 1, dividing a meshing line of a bilateral profile into eight functional segments; step 2, constructing each functional segment by using a cubic NURBS curve; and step 3, locally adjusting the functional segments of the meshing line by adjusting control points or weight factors of the NURBS curve, and observing corresponding changes of the rotor profile so as to adjust corresponding geometrical parameters. The design means is flexible and convenient, the change of the profile is controlled by adjusting the free curve, and the meshing line is locally adjusted in combination with the corresponding relationship between the meshing line and the rotor profile to observe the corresponding change trends, particularly the changes in leak triangle, contact line length, intertooth area and area utilization coefficient, of the male and female rotor profile, so that the design efficiency of the rotor profile of a twin-rotor screw compressor is improved, and
(Continued)

the defect in the prior art that the rotor profile cannot be locally modified is avoided.

5 Claims, 8 Drawing Sheets

(51) Int. Cl.
*F04C 18/08* (2006.01)
*F04C 2/08* (2006.01)

(52) U.S. Cl.
CPC ..... *F04C 2230/90* (2013.01); *F04C 2240/20* (2013.01); *F04C 2250/20* (2013.01)

(58) Field of Classification Search
USPC ..... 418/150, 201.3, 206.5
See application file for complete search history.

(56) References Cited

FOREIGN PATENT DOCUMENTS

| | | | |
|---|---|---|---|
| CN | 106194717 | A | 12/2016 |
| CN | 107023480 | A | 8/2017 |

* cited by examiner

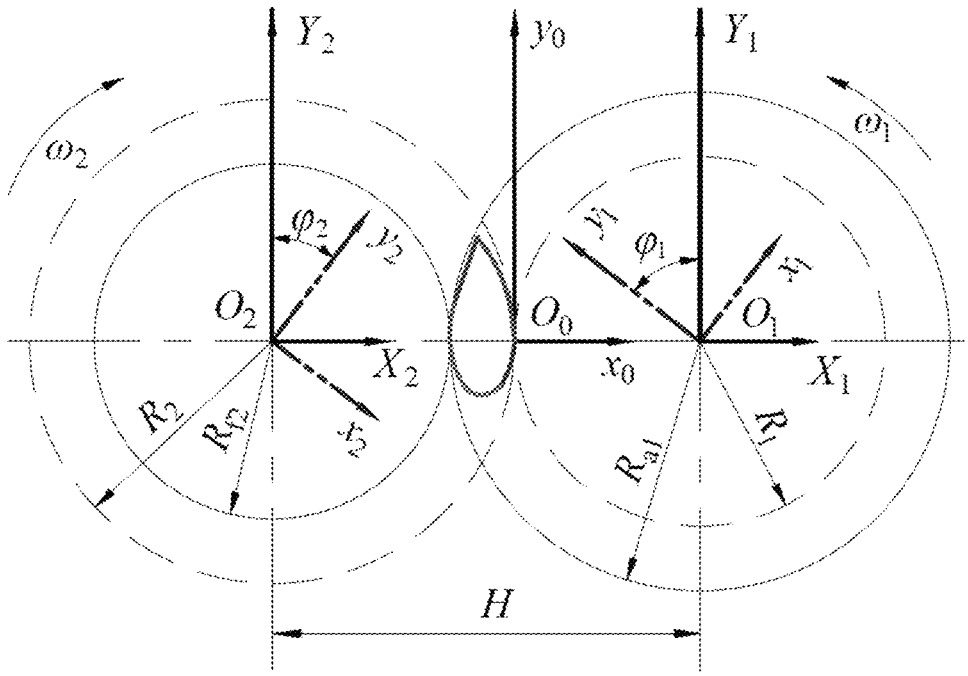
Figure.1
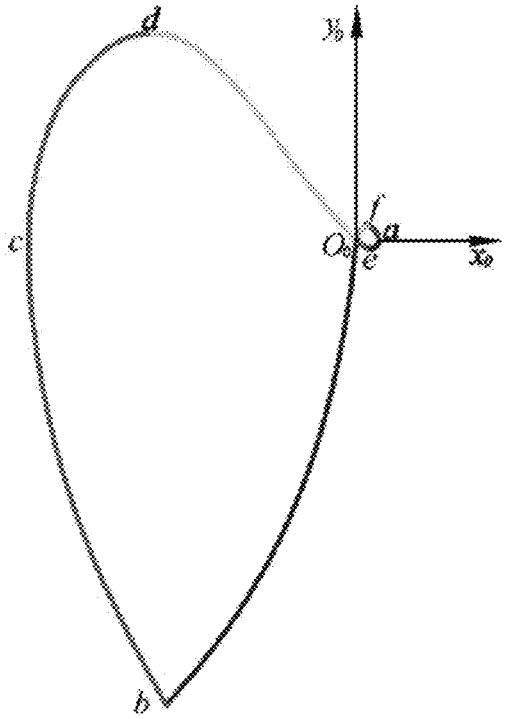
Figure.2（a）

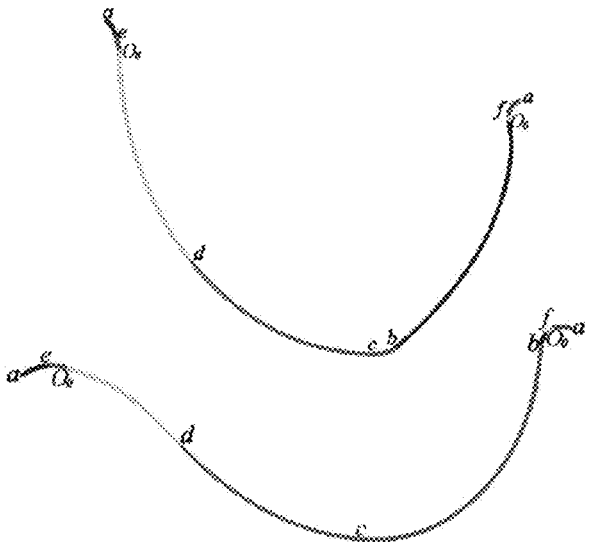
Figure.2（b）
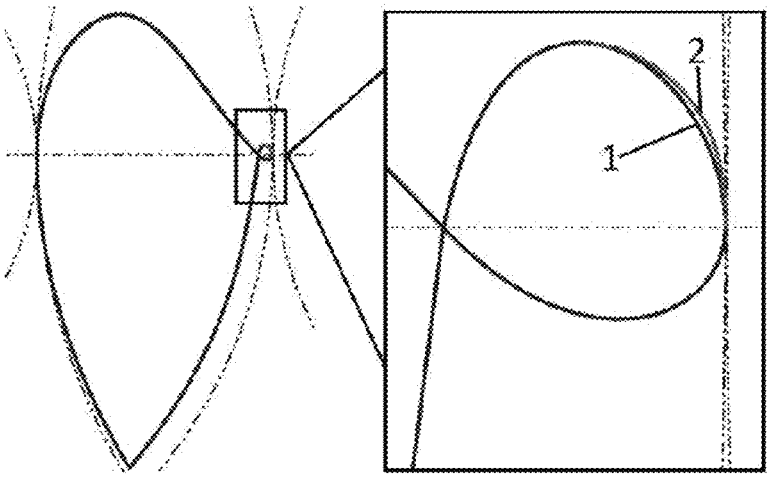
Figure.3

METHOD FOR MODIFYING PERFORMANCE OF ROTOR PROFILE BY ADJUSTING MESHING LINE SEGMENTS

TECHNICAL FIELD

The present disclosure belongs to the technical field of compressors, and particularly relates to a method for modifying performance of a rotor profile by adjusting meshing line segments.

BACKGROUND

From the beginning of development of screw rotor profiles, scholars have been exploring new design methods and calculation methods thereof. The design methods are generally divided into two types according to different initial design objects: forward design and reverse design. In the decades after the advent of screw compressors, the forward design method was basically adopted, that is, the profile of another screw rotor was derived from the known data of one screw rotor profile. The forward design theory is very mature at present. However, the working performance of the compressor cannot be directly predicted by the rotor profile, and must be judged by the meshing line of male and female rotors. It usually needs repeated revision and verification to obtain a complete screw rotor profile with better performance, so the entire design process is very complicated. A good rotor profile should have a large flow cross-sectional area, a short space contact line and a small leak triangle, and the changes in these geometric performance parameters can be intuitively observed by adjusting the meshing line. At present, the design and optimization of rotor profiles are mostly limited to simple curves such as points, straight lines and quadratic curves. The generated screw rotor profile is not good, resulting in a large aerodynamic loss during the operation of the compressor. Moreover, it is unlikely to adjust the local curve in the forward or reverse design to achieve the purpose of optimizing the curve. The conventional screw rotor profile design method still focuses on the forward design, the reverse design process is seldom explored, and systematically dividing the meshing line to study the influence of the local change of the meshing line on the change rule of the rotor profile is not carried out.

SUMMARY

In order to solve the existing technical problems, the present disclosure provides a method for modifying performance of a rotor profile by adjusting meshing line segments. In the present disclosure, the meshing line is locally adjusted in the reverse design process of a screw rotor profile according to the design requirements to observe the size changes in flow cross-sectional area, spatial contact lines and leak triangle in real time, so as to optimize the design of the rotor profile.

The objective of the present disclosure is achieved by the following technical solution: a method for modifying performance of a rotor profile by adjusting meshing line segments, comprising the following steps:

step 1, dividing a meshing line of a bilateral profile into eight functional segments;

step 2, constructing each functional segment by using a cubic NURBS curve; and step 3, locally adjusting the functional segments of the meshing line by adjusting control points or weight factors of the NURBS curve, and observing corresponding changes of the rotor profile so as to adjust corresponding geometrical parameters;

where the rotor profile is the intersecting line between the helical surface of the screw rotor and the section perpendicular to the rotor shaft.

Further, the eight functional segments comprises af, $fo_0$, $o_0b$, bc, cd, $do_0$, $o_0e$ and ea, where point a is the rightmost intersection of the meshing line and the $x_0$ axis, i.e., the tangent point of the tip circle a female rotor and the root circle of a male rotor, point b is the lowest point of the meshing line in the III quadrant, point c is a point farthest from the coordinate origin $O_0$ in the horizontal direction on the meshing line, i.e., the tangential point of the tip circle of the male rotor and the root circle of the female rotor, point d is the highest point of the meshing line in the II quadrant, point e is the lowest point of the meshing line in the IV quadrant, and point f is the highest point of the meshing line in the I quadrant.

Further, step 2 specifically comprises the following steps:

step 2.1, establishing reverse design coordinates, and establishing a conversion relation between male and female rotor coordinates and meshing line static coordinates;

step 2.2, establishing a meshing condition relation according to a tooth profile normal method, and establishing a one-to-one mapping relation between rotor rotation angles and design parameters, i.e., an envelope condition formula:

$$\varphi_1 = -\int_{t_0}^{t} \frac{y_0 y_0' + x_0 x_0'}{R_1 y_0} dt + \varphi_0,$$

where $R_1$ is the radius of the pitch circle of a male rotor; $\varphi_1$ is an initial rotation angle of a male rotor, referred to as a rotation angle parameter; $\varphi_0$ is a constant, an integral result of the end point of the previous curve segment, and a starting angle of meshing for the first curve segment of the meshing line, $\varphi_0=0$;

step 2.3, designing a cubic NURBS spline curve segment of the meshing line, the parameter equation thereof being obtained by derivatives and interpolation at a specified data point and two end points, and a parameter equation for a NURBS curve segment of the meshing line being set as follows:

$$\begin{cases} x_0 = C_x(u) \\ y_0 = C_y(u) \end{cases}, 0 \le u \le 1,$$

where $$C(u) = \frac{\sum_{i=0}^{n} N_{i,k}(u) w_i P_i}{\sum_{i=0}^{n} N_{i,k}(u) w_i}, a \le u \le b,$$

k is the degree of curves; $P_i$ is a control point, having the number of n+1; $w_i$ is a weight factor of the control point $P_i$, determining the extent to which the control point deviates from the curve, and all $w_i>0$ $N_{i,k}(u)$ is a k-degree B spline basis function defined on an aperiodic and non-uniform node vector $U=\{a, \ldots, a, u_{k+1}, \ldots, u_{m-p-1}, b, \ldots, b\}$, having the number of m+1, wherein the number of a and b is k+1, and m=n+k+1, a=0, b=1;

substituting the parametric equation into the envelope condition formula to obtain the following formula:

$$\varphi_1 = -\int_0^u \frac{C_y(u)C'_y(u) + C_x(u)C'_x(u)}{R_1 C_y(u)} dt + \varphi_0,$$

$$\text{let } f(u) = \frac{C_y(u)C'_y(u) + C_x(u)C'_x(u)}{C_y(u)}, \text{ then}$$

$$\varphi_1 = -\frac{1}{R_1}\int_0^u f(u)dt + \varphi_0;$$

substituting the numerical integration result of any point on the meshing line into the meshing condition relation to obtain a one-to-one mapping relation between rotor rotation angles and design parameters; and step 2.4, obtaining a male and female rotor profile equation corresponding to the meshing line of the NURBS spline curve segment using the meshing condition relation and the conversion relation between male and female rotor coordinates and meshing line static coordinates simultaneously.

Further, the $f(u)$ is solved using the following Romberg quadrature formula:

$$T_m^{(k)} = \frac{4^m T_{m-1}^{(k+1)} - T_{m-1}^{(k)}}{4^m - 1}$$

$$(m = 1, 2, \ldots, k = 0, 1, 2, \ldots),$$

where $$T_m^{(k)} = I_{m+1}\left(\frac{b-a}{2^k}\right);$$

$I=\int_a^b f(u)dx$, and the interval [a, b] is equally divided into $2^k$ portions;

the specific steps are as follows:

A, determining a corresponding integrand $f(u)$ on the meshing line segment according to the NURBS curve parameter equation, setting a=0 and b=u, and setting the solution precision ε;

B, setting the initial step size $$h = b - a,\ T_0^{(0)} = \frac{h}{2}[f(a) + f(b)]$$

and initializing k=1;

C, calculating an iterative formula and using the formula to calculate:

$$T_0^{(k)} = \frac{1}{2}\left[T_0^{(k-1)} + h\sum_{i=0}^{2^k-1} f\left(a + \left(i + \frac{1}{2}\right)h\right)\right],$$

then calculating:

$$T_m^{(k-m)} = \frac{4^m T_{m-1}^{(k-m+1)} - T_{m-1}^{(k-m)}}{4^m - 1},\ m = 1, 2, \ldots, k,$$

D, judging whether the precision requirement is met by judging whether a difference between the previous and late iteration results is smaller than a precision value, i.e., $|T_m^{(0)} - T_{m-1}^{(0)}| < \varepsilon$; if the requirement is met, stopping the calculation and outputting $T_k^{(0)}$; if the requirement is not met, setting $$h = \frac{h}{2},\ k = k + 1,$$

and then returning to step C;

wherein if the point on the meshing line segment is on the x axis, $C_y(u_0)=0$, and the point is the first type of discontinuity point of the function $f(u)$; according to the design requirement of the meshing line, the point passing through the x axis on the meshing line must satisfy $C_x(u_0)=0$ or $C'_x(u_0)=0$, and the function value at this point is substituted with a limit value for solving; and it can be obtained using the L'Hospital's rule:

$$f(u) = \begin{cases} \lim\limits_{u \to u_0} \dfrac{C_x(u)C'_x(u) + C_y(u)C'_y(u)}{C_y(u)} = \dfrac{C'_x(u)C'_x(u)}{C'_y(u)} + C'_y(u), & C_x(u_0) = 0 \\ \lim\limits_{u \to u_0} \dfrac{C_x(u)C'_x(u) + C_y(u)C'_y(u)}{C_y(u)} = \dfrac{C_x(u)C''_x(u)}{C'_y(u)} + C'_y(u), & C'_x(u_0) = 0 \end{cases}.$$

Further, step 3 is specifically: adjusting the control vertexes of the eight functional segments af, $fo_0$, $o_0b$, bc, cd, $do_0$, $o_0e$ and ea of the meshing line respectively to observe corresponding changes of the rotor profile, or slightly adjusting the weight factor $w_i$ of the control point of the NURBS curve of each functional segment to control the local curve variation of the meshing line, thereby adjusting the rotor profile and observing the changes in leak triangle, contact line length, inter-tooth area and area utilization coefficient.

Starting from the reverse design method of the rotor profile, the meshing line of the bilateral profile is divided into eight functional segments, the NURBS curve is used to construct meshing line segments, corresponding changes of the rotor profile are modified by locally adjusting the meshing line segments, and therefore the profile meeting the performance requirements is designed according to the design needs. The design means is flexible and convenient, the change of the profile is controlled by adjusting the free curve, and the meshing line is locally adjusted in combination with the corresponding relationship between the meshing line and the rotor profile to observe the corresponding change trends, particularly the changes in leak triangle, contact line length, inter-tooth area and area utilization coefficient, of the male and female rotor profile, so that the design efficiency of the rotor profile of a twin-rotor screw compressor is improved, and the defect in the prior art that the rotor profile cannot be locally modified is avoided.

BRIEF DESCRIPTION OF FIGURES

FIG. 1 is a coordinate conversion relation diagram in a reverse design method;

FIG. 2(*a*) is a meshing line segment diagram;

FIG. 2(*b*) is a rotor tooth profile diagram corresponding to the meshing line segment diagram;

FIG. 3 is a meshing line shape diagram of the meshing line segment af before and after moving, where 1 represents before moving and 2 represents after moving;

DETAILED DESCRIPTION

Figure 4:
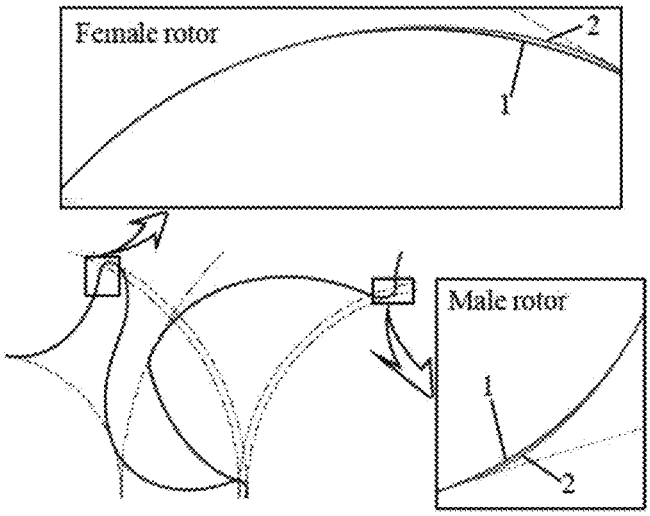
FIG. 4 is a diagram showing corresponding changes in the rotor profile before and after the meshing line segment af moves, where 1 represents before moving and 2 represents after moving.
Figure 5:
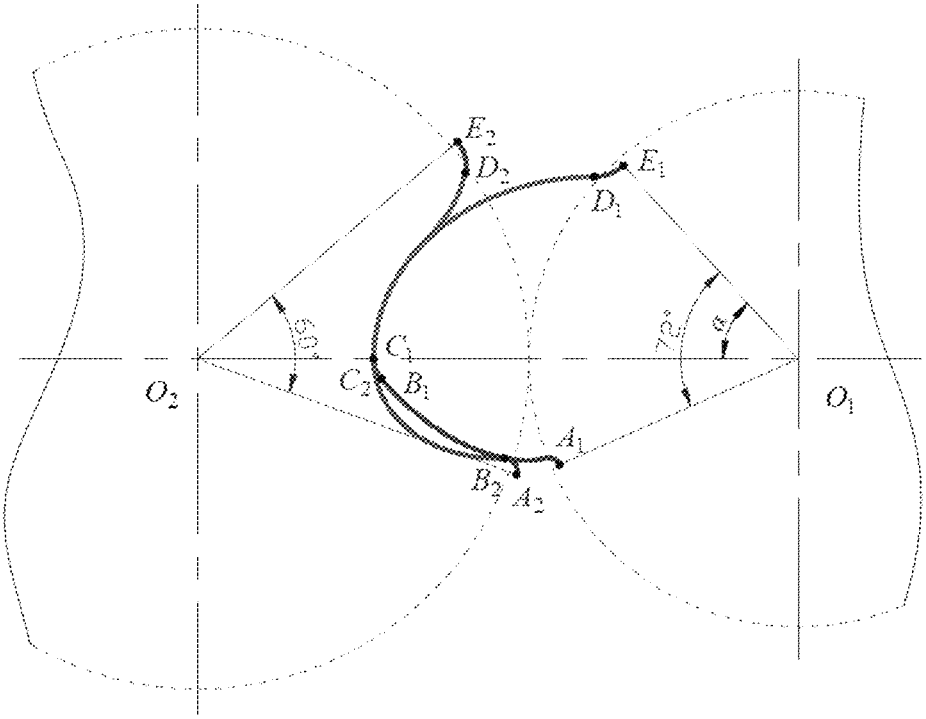
FIG. 5 is a male and female rotor profile of a Fusheng profile.

A clear and complete description will be made to the technical solutions in the embodiments of the present disclosure below in combination with the accompanying drawings in the embodiments of the present disclosure. Apparently, the embodiments described are only part of the embodiments of the present disclosure, not all of them. All other embodiments obtained by a person of ordinary skill in the art based on the embodiments of the present disclosure without creative efforts shall fall within the protection scope of the present disclosure.

Example 1

Referring to FIG. 1 to FIG. 4, FIG. 1 is a coordinate conversion relation diagram in a reverse design method, where $O_0x_0y_0$ is meshing line static coordinates, $O_1x_1y_1$ is male rotor rotating coordinates, $O_2x_2y_2$ is female rotor rotating coordinates, $O_1x_1y_1$ is male rotor static coordinates, $O_2x_2y_2$ are female rotor static coordinates, $\varphi_2$, $\varphi_1$ are respectively rotating amounts of the male and female rotor rotating coordinates $O_2x_2y_2$ and $O_1x_1y_1$ relative to the male and female rotor static coordinates $O_2x_2y_2$ and $O_1x_1y_1$, $\omega_2$, $\omega_1$ are respectively rotating speeds of male and female rotors, $R_2$, $R_1$ are respectively radii of the pitch circles of the male and female rotors, $R_{a1}$ is the radius of the tip circle of the male rotor, $R_{f2}$ is the radius of the root circle of the female rotor, satisfying $R_{a1}+R_{f2}=H$.

The present disclosure proposes a method for modifying performance of a rotor profile by adjusting meshing line segments, including the following steps:

Step 1, dividing a meshing line of a bilateral profile into eight functional segments, wherein the eight functional segments includes af, $fo_0$, $o_0b$, bc, cd, $do_0$, $o_0e$ and ea, point a is the rightmost intersection of the meshing line and the $x_0$ axis, i.e., the tangent point of the tip circle of the female rotor and the root circle of the male rotor, point b is the lowest point of the meshing line in the III quadrant, point c is a point farthest from the coordinate origin $O_0$ in the horizontal direction on the meshing line, i.e., the tangential point of the tip circle of the male rotor and the root circle of the female rotor, point d is the highest point of the meshing line in the II quadrant, point e is the lowest point of the meshing line in the IV quadrant, and point f is the highest point of the meshing line in the I quadrant. When a meshing line of a unilateral profile is studied, point a coincides with the origin of the coordinate system. The meshing line of the unilateral profile exists only in the second and third quadrants of the static coordinates of the meshing line, whereas the meshing line of the bilateral profile is distributed in the four quadrants of the static coordinates.

Step 2, constructing each functional segment by using a cubic NURBS curve. Step 2 specifically includes the following steps:

step 2.1, establishing reverse design coordinates, and establishing a conversion relation between male and female rotor coordinates and meshing line static coordinates; it can be seen from the FIG. 1, meshing line static coordinates $O_0x_0y_0$ are converted to male rotor rotating coordinates $O_1x_1y_1$:

$$\begin{cases} x_1 = x_0\cos\varphi_1 + y_0\sin\varphi_1 - R_1\cos\varphi_1 \\ y_1 = -x_0\sin\varphi_1 + y_0\cos\varphi_1 + R_1\sin\varphi_1 \end{cases},$$

meshing line static coordinates $O_0x_0y_0$ are converted to female rotor rotating coordinates $O_2x_2y_2$:

$$\begin{cases} x_2 = x_0\cos\varphi_2 - y_0\sin\varphi_2 + R_2\cos\varphi_2 \\ y_2 = x_0\sin\varphi_2 + y_0\cos\varphi_2 + R_2\sin\varphi_2 \end{cases},$$

step 2.2, establishing a meshing condition relation according to a tooth profile normal method, and establishing a one-to-one mapping relation between rotor rotation angles and design parameters, i.e., an envelope condition formula:

$$\varphi_1 = -\int_{t_0}^{t} \frac{y_0y_0' + x_0x_0'}{R_1y_0}dt + \varphi_0,$$

where $R_1$ is the radius of the pitch circle of a male rotor; $\varphi_1$ is an initial rotation angle of a male rotor, referred to as a rotation angle parameter; $\varphi_0$ is a constant, an integral result of the end point of the previous curve segment, and a starting angle of meshing for the first curve segment of the meshing line, $\varphi_0=0$;

step 2.3, designing a cubic NURBS spline curve segment of the meshing line, the parameter equation thereof being obtained by derivatives and interpolation at a specified data point and two end points, and a parameter equation for a NURBS curve segment of the meshing line being set as follows:

$$\begin{cases} x_0 = C_x(u) \\ x_y = C_y(u) \end{cases}, 0 \le u \le 1,$$

where $$C(u) = \frac{\sum_{i=0}^{n} N_{i,k}(u) w_i P_i}{\sum_{i=0}^{n} N_{i,k}(u) w_i}, \; a \le u \le b,$$

k is the degree of curves; $P_i$ is a control point, having the number of n+1; $w_i$ is a weight factor of the control point $P_i$, determining the extent to which the control point deviates from the curve, and all $w_i>0$; $N_{i,k}(u)$ is a k-degree B spline basis function defined on an aperiodic and non-uniform node vector $U=\{a, \ldots, a, u_{k+1}, \ldots, u_{m-p-1}, b, \ldots, b\}$, having the number of m+1, wherein the number of a and b is k+1, and m=n+k+1; a=0, b=1;

substituting the parametric equation into the envelope condition formula to obtain the following formula:

$$\varphi_1 = -\int_0^u \frac{C_y(u)C'_y(u) + C_x(u)C'_x(u)}{R_1 C_y(u)} dt + \varphi_0,$$

$$\text{let } f(u) = \frac{C_y(u)C'_y(u) + C_x(u)C'_x(u)}{C_y(u)}, \text{ then } \varphi_1 = -\frac{1}{R_1}\int_0^u f(u)dt + \varphi_0;$$

substituting the numerical integration result of any point on the meshing line into the meshing condition relation to obtain a one-to-one mapping relation between rotor rotation angles and design parameters; and solving the f(u) using the Romberg quadrature formula:

$$T_m^{(k)} = \frac{4^m T_{m-1}^{(k+1)} - T_{m-1}^{(k)}}{4^m - 1} (m = 1, 2, \ldots, k = 0, 1, 2, \ldots),$$

where $$T_m^{(k)} = I_{m+1}\left(\frac{b-a}{2^k}\right); \; I = \int_a^b f(u)dx,$$

and the interval [a, b] is equally divided into $2^k$ portions;

The specific steps are as follows:

A, determining a corresponding integrand f(u) on the meshing line segment according to the NURBS curve parameter equation, setting a=0 and b=u, and setting the solution precision ε;

B, setting the initial step size $$h = b - a, \; T_0^{(0)} = \frac{h}{2}[f(a) + f(b)]$$

and initializing k=1;

C, calculating an iterative formula and using the formula to calculate:

$$T_0^{(k)} = \frac{1}{2}\left[T_0^{(k-1)} + h\sum_{i=0}^{2^k-1} f\left(a + \left(i + \frac{1}{2}\right)h\right)\right],$$

then calculating:

$$T_m^{(k-m)} = \frac{4^m T_{m-1}^{(k-m+1)} - T_{m-1}^{(k-m)}}{4^m - 1}, \; m = 1, 2, \ldots, k,$$

D, judging whether the precision requirement is met by judging whether a difference between the previous and late iteration results is smaller than a precision value, i.e., $|T_m^{(0)} - T_{m-1}^{(0)}| < \varepsilon$; if the requirement is met, stopping the calculation and outputting $T_k^{(0)}$; if the requirement is not met, setting $$h = \frac{h}{2}, \; k = k + 1,$$

and then returning to step C;

wherein if the point on the meshing line segment is on the x axis, $C_y(u_0)=0$, and the point is the first type of discontinuity point of the function f(u); according to the design requirement of the meshing line, the point passing through the x axis on the meshing line must satisfy $C_x(u_0)=0$ or $C'_x(u_0)=0$, and the function value at this point is substituted with a limit value for solving; and it can be obtained using the L'Hospital's rule:

$$f(u) = \begin{cases} \lim\limits_{u \to u_0} \dfrac{C_x(u)C'_x(u) + C_y(u)C'_y(u)}{C_y(u)} = \dfrac{C'_x(u)C'_x(u)}{C'_y(u)} + C'_y(u), & C_x(u_0) = 0 \\ \lim\limits_{u \to u_0} \dfrac{C_x(u)C'_x(u) + C_y(u)C'_y(u)}{C_y(u)} = \dfrac{C_x(u)C''_x(u)}{C'_y(u)} + C'_y(u), & C'_x(u_0) = 0 \end{cases};$$

and step 2.4, obtaining a male and female rotor profile equation corresponding to the meshing line of the NURBS spline curve segment using the meshing condition relation and the conversion relation between male and female rotor coordinates and meshing line static coordinates simultaneously.

Step 3: locally adjusting the functional segments of the meshing line by adjusting control points or weight factors of the NURBS curve, and observing corresponding changes of the rotor profile so as to adjust corresponding geometrical parameters. Step 3 is specifically: adjusting the control vertexes of the eight functional segments af, $fo_0$, $o_0b$, bc, cd, $do_0$, $o_0e$ and ea of the meshing line respectively to observe corresponding changes of the rotor profile, or slightly adjusting the weight factor $w_i$ of the control point of the NURBS curve of each functional segment to control the local curve variation of the meshing line, thereby adjusting the rotor profile and observing the changes in leak triangle, contact line length, inter-tooth area and area utilization coefficient.

FIG. 2 shows meshing line segments and a corresponding rotor profile thereof, wherein FIG. 2(*a*) is a meshing line segment diagram, the meshing line is divided into eight functional segments by six control points a, b, c, d, e and f, and the origin of coordinates, and FIG. 2(*b*) is a rotor tooth profile diagram corresponding to the meshing line. Based on the NURBS rotor meshing line formula derived above, each functional segment of the meshing line is expressed using cubic NURBS, and then the shape of each meshing line segment can be adjusted to observe the corresponding rotor tooth profile change. FIG. 3 shows a meshing line shape of the meshing line segment af before and after moving, where 1 represents before moving and 2 represents after moving. FIG. 4 shows corresponding changes in the rotor profile before and after the meshing line segment af moves, where 1 represents before moving and 2 represents after moving. It can be found that after the meshing line segment af moves to the upper right by a distance, a high-pressure side profile, close to the inner wall of the casing, nearby the tooth crest of the female rotor changes in the direction of increasing the thickness of the tooth crest, and meanwhile, the curvature of this part of tooth profile increases, and the inter-tooth area decreases. Similarly, after the meshing line segment af moves to the upper right by a distance, the high-pressure side profile at the bottom of the tooth socket of the male rotor changes in the direction of increasing the width of the bottom of the tooth socket, the curvature of the corresponding tooth profile of the male rotor also increases, and the inter-tooth area increases. Conversely, if the meshing line segment af moves to the lower left, the male and female rotor profiles described above will change in the opposite directions.

Similarly, the remaining seven segments can be studied using the same method. If the increasing direction of the area surrounded by the adjusted meshing line is defined as "outside", the opposite direction is "inside". Finally, the influence of each meshing line segment on the performance parameters of the rotor profile is shown in Table 1.

TABLE 1

Influence of each meshing line segment on performance parameters of rotor profile

| Meshing line segment | Adjustment direction | Leak triangle | Contact line length | Inter-tooth area of male rotor | Inter-tooth area of female rotor | Area utilization coefficient |
|---|---|---|---|---|---|---|
| af | Outside | ↓ | ↑ | ↑ | ↓ | ↑ |
| $fo_0$ | Outside | ↓ | ↑ | ↑ | ↓ | ↑ |
| $o_0b$ | Outside | ↓ | ↑ | ↑ | ↓ | ↑ |
| bc | Inside | ↑ | ↓ | ↓ | ↑ | ↓ |
| cd | Inside | — | ↓ | ↓ | ↑ | ↓ |
| $do_0$ | Outside | — | ↑ | ↑ | ↓ | ↑ |
| $o_0e$ | Inside | — | ↓ | ↓ | ↑ | ↓ |
| ea | Outside | — | ↑ | ↑ | ↓ | ↑ |

Similarly, the adjustment direction of the meshing line can also be changed by adjusting the weight factors of the control point of the NURBS meshing line, the change direction of the meshing line at the control point is inward by reducing the weight factors and the change direction of the meshing line at the control point is outward by increasing the weight factors, so that the law of changing the weight factors to adjust the performance parameters of the rotor is similar to that of the above table.

Example 2

Figure 6:
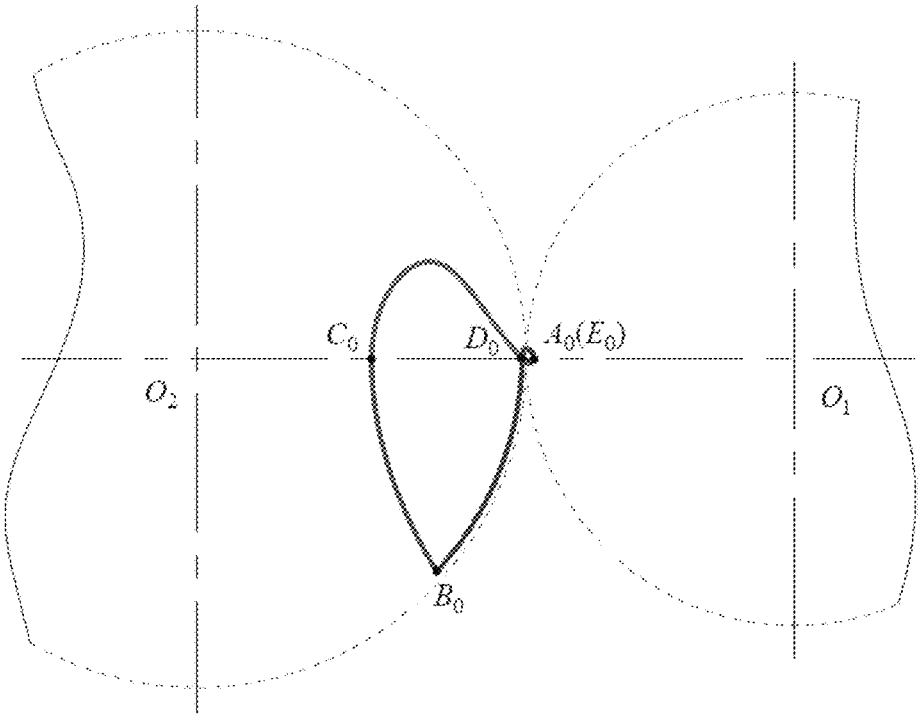
FIG. 6 is a meshing line of a Fusheng profile.

Referring to FIG. 5 to FIG. 13, FIG. 5 shows an existing Fusheng profile, FIG. 6 shows a meshing line corresponding to the Fusheng profile, and Table 2 shows relevant design data of the Fusheng profile.

TABLE 2

Relevant Design data of Fusheng profile

| | Female rotor | | Male rotor | | Meshing line |
|---|---|---|---|---|---|
| Segment mark | Tooth curve | Curve property | Tooth curve | Curve property | Corresponding tooth curve |
| 1 | $A_2B_2$ | Arc | $A_1B_1$ | Arc envelope line | $A_0B_0$ |
| 2 | $B_2C_2$ | Arc envelope line | $B_1C_1$ | Arc | $B_0C_0$ |
| 3 | $C_2D_2$ | Elliptical arc envelope line | $C_1D_1$ | Elliptical arc | $C_0D_0$ |
| 4 | $D_2E_2$ | Arc envelope line | $D_1E_1$ | Arc | $D_0E_0$ |
| Tooth ratio 1/i of male and female rotors | | | | 6/5 | |
| Center distance H/(mm) | | | | 82 | |
| Angle α/(°) | | | | 48 | |

Figure 7:
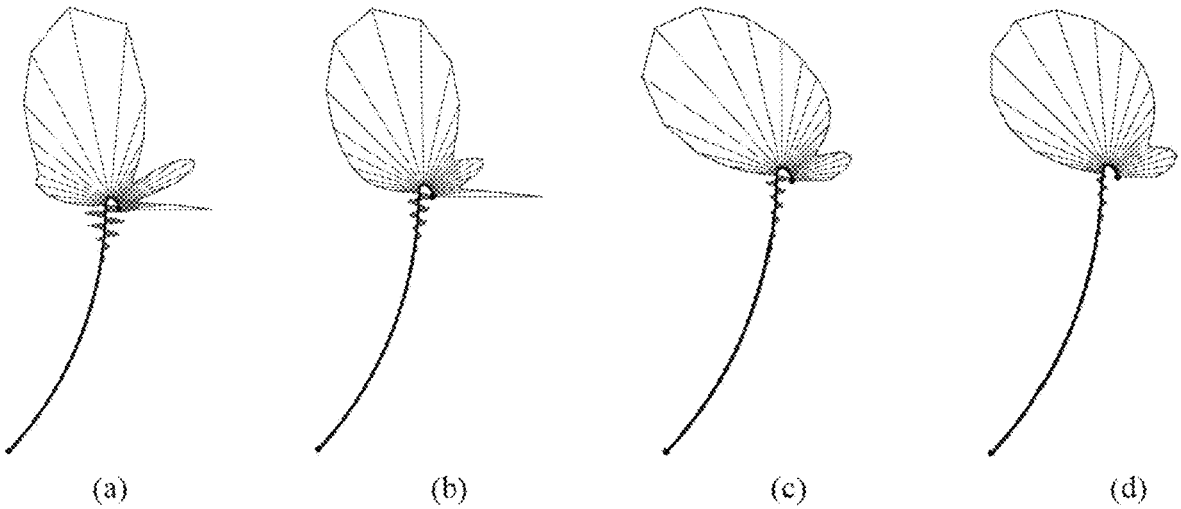
FIG. 7 shows curvature combs of the meshing line segment $A_0B_0$ of the Fusheng profile constructed with different orders of NURBS, where (a) is a cubic NURBS curve, (b) is a quartic NURBS curve, (c) is a quintic NURBS curve, and (d) is a sextic NURBS curve.
Figure 8:
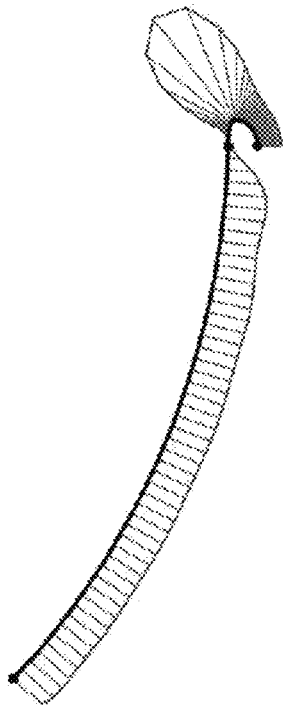
FIG. 8 is a curvature comb of the meshing line $A_0B_0$ of the Fusheng profile after addition of segmentation points.
Figure 9:
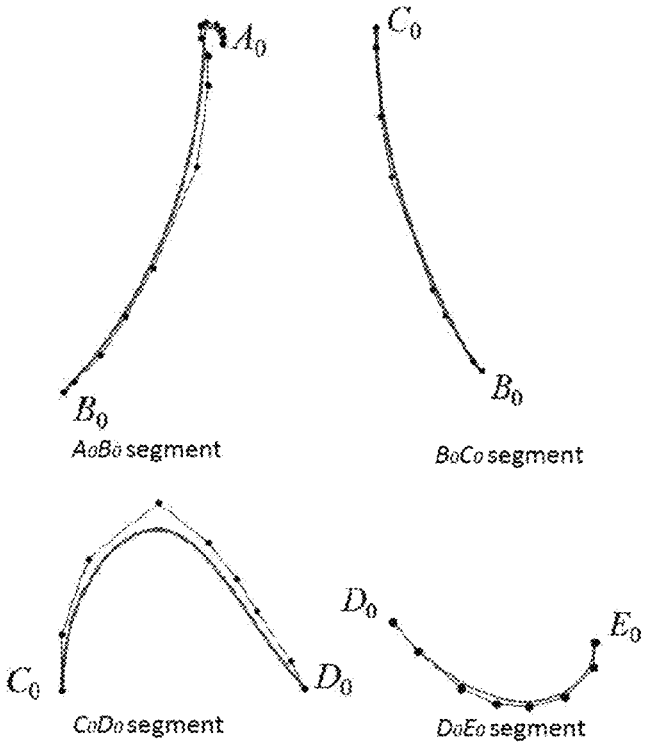
FIG. 9 is a control point distribution effect diagram of Fusheng meshing line constructed with an NURBS curve.
Figure 10:
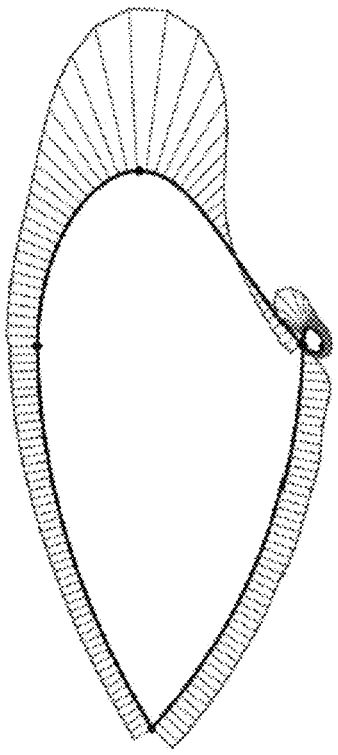
FIG. 10 is an overall curvature comb diagram of Fusheng meshing line constructed with the NURBS curve.

Now a cubic NURBS curve is used to reversely construct the Fusheng profile. The meshing line of the Fusheng profile is a bilateral profile, the meshing line thereof is on two sides of the pitch circle, and the right area is small, so that the curvature of the meshing line changes dramatically, and a lot of control points are needed to meet the requirement of high-precision fitting. Taking the $A_0B_0$ segment as an example, as shown in FIG. 7, although the curvatures of cubic to sextic curvature combs gradually become smooth with the increase of degree under the same number of control points, the changes still fluctuate obviously, so that when the meshing line is fitted, a few segmentation points need to be added to ensure smoother curvature transition. As shown in FIG. 8, it can be seen that the curvature of the $A_0B_0$ segment becomes smoother obviously after a segmentation point is added. In the same way, segmentation points are added in other parts where the curvatures easily change, the construction effect of each segment is shown in FIG. 9, and the final fitting result is shown in FIG. 10. As shown in Table 3, the fitting precision is high and the curvature changes are stable.

TABLE 3

| Fitting precision | | | | | | |
|---|---|---|---|---|---|---|
| Meshing line | | | Male rotor | | Female rotor | |
| Tooth curve | Number of control points | Precision error/(μm) | Corresponding segment | Precision error/(μm) | Corresponding segment | Precision error/(μm) |
| $A_0B_0$ | 51 | 0.092 | $A_1B_1$ | 0.296 | $A_2B_2$ | 0.028 |
| $B_0C_0$ | 7 | 0.088 | $B_1C_1$ | 0.028 | $B_2C_2$ | 0.095 |
| $C_0D_0$ | 28 | 0.076 | $C_1D_1$ | 0.387 | $C_2D_2$ | 0.388 |
| $D_0E_0$ | 14 | 0.018 | $D_1E_1$ | 0.442 | $D_2E_2$ | 0.443 |

Figure 11:
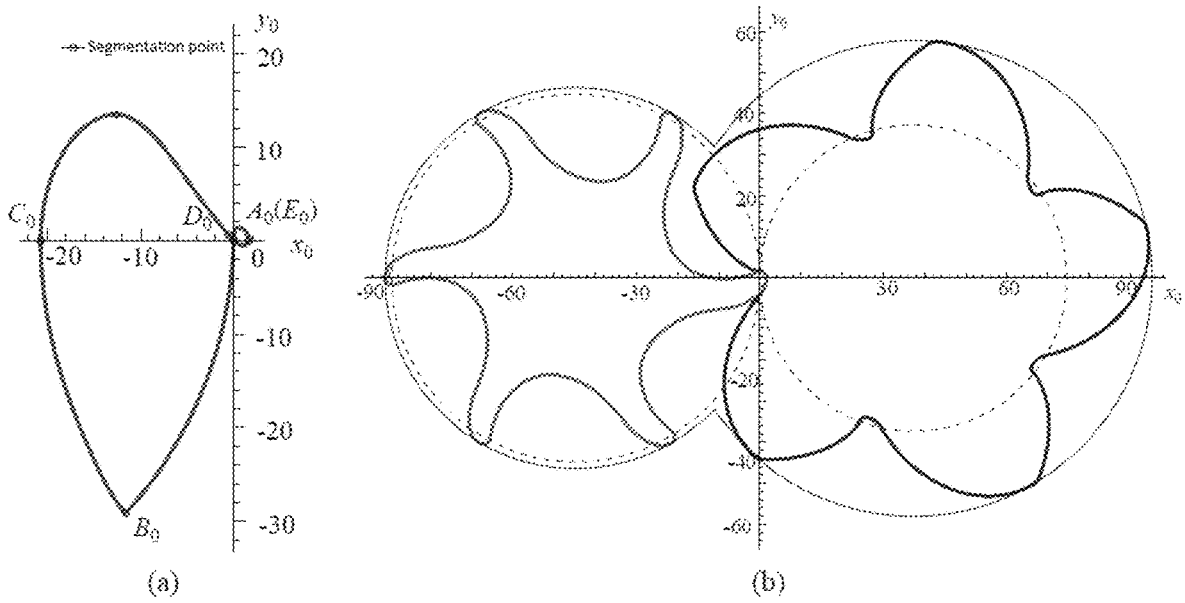
FIG. 11 is a final effect diagram of an NURBS curve reversely-designed Fusheng profile, where (a) shows a meshing line and (b) shows generated male and female rotor profiles.

The finally generated curve is shown in FIG. 11, where (a) shows a meshing line constructed with an NURBS and (b) shows corresponding male and female rotor profiles. It can be found that the rotor profile is different from that of FIG. 5 by one angle, because different starting meshing points are defined in the forward and reverse design methods, the starting point in the forward method is at the root circle of the female rotor, while the starting point in the reverse method is at the root circle of the male rotor, the male rotors of the two methods are different by 24°, that is, the female rotors are different by 20°.

Figure 12:
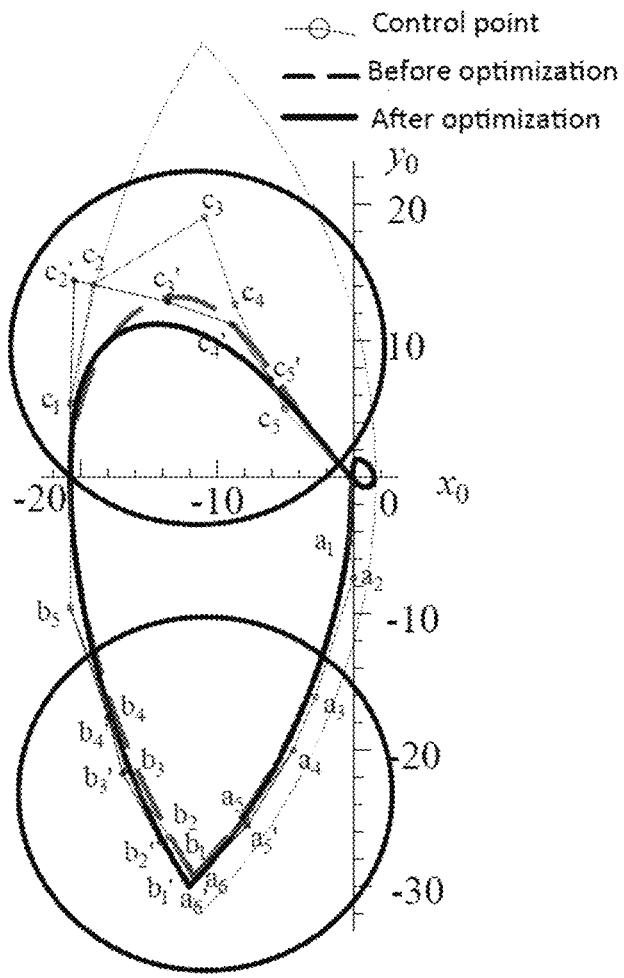
FIG. 12 is a comparison diagram of control points before and after the meshing line is improved and optimized.
Figure 13:
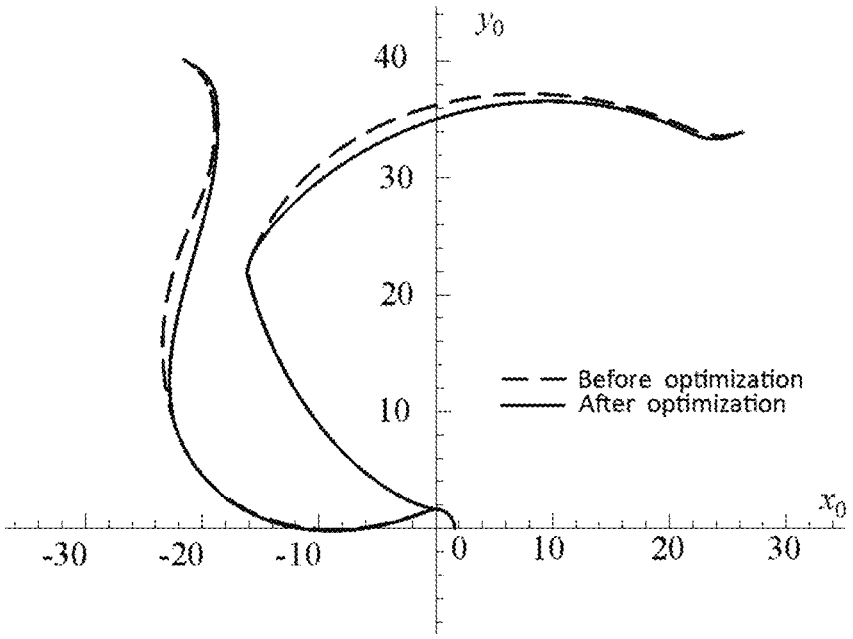
FIG. 13 is a comparison diagram of the profile before and after improvement and optimization.

Since the meshing line consists of a NURBS curve, the local shape of the meshing line can be conveniently modified by the local modification of the NURBS curve and the method for modifying the performance of the rotor profile by adjusting the meshing line segments according to the present disclosure, so as to achieve the purpose of optimizing the performance of the profile. The profile is optimized mainly to reduce the area of the leak triangle and increase the area utilization coefficient without changing the original rotor structure, such as the size of the tooth crest arc and the tooth ratio of the male and female rotors. The shape of the meshing line can be directly changed by moving the positions of the control points. The meshing lines before and after the improvement are shown in FIG. 12 (wherein $a_1$, $a_2$ $a_3$, $a_4$, $a_5$, $a_6$, $a'_5$, $a'_6$, $b_1$, $b_2$ $b_3$, $b_4$, $b_5$, $b'_1$, $b'_2$, $b'_3$, $b'_4$, $c_1$, $c_2$, $c_3$, $c_4$, $c_5$, $c'_1$, $c'_2$, $c'_3$, $c'_4$, $c'_5$ are all control points), the corresponding profile changes are shown in FIG. 13, and the comparison of performance parameters is shown in Table 4. It can be seen that the optimized profile increases the thickness of the female rotor, increases the area utilization coefficient, and reduces the area of the leak triangle.

TABLE 4

| Comparison of performance parameters | | | | | |
|---|---|---|---|---|---|
| | Leak triangle area/($mm^2$) | Contact line length/(mm) | Inter-tooth area of male rotor/($mm^2$) | Inter-tooth area of female rotor/($mm^2$) | Area utilization coefficient |
| Before improvement | 4.259 | 147.732 | 600.742 | 618.982 | 0.454 |
| After improvement | 4.236 | 152.140 | 633.420 | 602.770 | 0.460 |

What is claimed is:

1. A method for modifying performance of a rotor profile by adjusting meshing line segments, comprising:

step 1, dividing a meshing line of a bilateral profile into eight functional segments;

step 2, constructing each of the eight functional segments by using a cubic Non-Uniform Rational B-Spline (NURBS) curve; and step 3, locally adjusting the functional segments of the meshing line by adjusting control points or weight factors of the NURBS curve, and observing corresponding changes of the rotor profile so as to adjust corresponding geometrical parameters;

wherein the eight functional segments comprises $a_f$, $fo_0$, $o_0b$, bc, cd, $do_0$, $o_0e$ and ea, where point a is a rightmost intersection of the meshing line and $x_0$ axis, which is, a tangent point of a tip circle of a female rotor and a root circle of a male rotor, point b is a lowest point of the meshing line in a III quadrant, point c is a point farthest from coordinate origin $O_0$ in a horizontal direction on the meshing line, which is, a tangential point of a tip circle of a male rotor and a root circle of the female rotor, point d is a highest point of the meshing line in a II quadrant, point e is a lowest point of the meshing line in a IV quadrant, and point f is a highest point of the meshing line in a I quadrant.

2. The method according to claim 1, wherein the step 2 specifically comprises:

step 2.1, establishing reverse design coordinates, and establishing a conversion relation between male and female rotor coordinates and meshing line static coordinates;

step 2.2, establishing a meshing condition relation according to a tooth profile normal method, and establishing a one-to-one mapping relation between rotor rotation angles and design parameters, i.e., an envelope condition formula:

$$\phi_1 = -\int_{t_0}^{t} \frac{y_0 y_0' + x_0 x_0'}{R_1 y_0} dt + \phi_0$$

where $y_0$ is coordinate of the mesh line in corresponding y direction in a static coordinate system, $y_0'$ represents derivative of $y_0$ at parameter t, $x_0$ represents coordinate of the mesh line in corresponding x direction in the static coordinate system, and $x_0'$ represents $x_0$ derivative of the parameter t, to represents parameter value corresponding to a starting point of the meshing line, and t represents corresponding parameter value of a parameter point of corner to be obtained, $R_1$ is a radius of a pitch circle of the male rotor; $\varnothing_1$ is an initial rotation angle of the male rotor, referred to as a rotation angle parameter; $\varnothing_0$ is a constant, an integral result of an end point of a previous curve segment, and a starting angle of meshing for the first curve segment of the meshing line, $\varnothing_0=0$ step 2.3, designing a cubic NURBS spline curve segment of the meshing line, a parameter equation thereof being obtained by derivatives and interpolation at a specified data point and two end points, and a parameter equation for the NURBS curve segment of the meshing line being set as follow $$\begin{cases} x_0 = C_x(u) \\ y_0 = C_y(u) \end{cases}, 0 \le u \ll 1,$$

where $$C(u) = \frac{\sum_{i=0}^{n} N_{i,k}(u) w_i P_i}{\sum_{i=0}^{n} N_{i,k}(u) w_i}, a \le u \le b,$$

i=0, 1, 2, . . . n, k is the number of curves; $P_i$ is control point, having the number of n+1; $w_i$ is a weight factor of the control point $P_i$, determining extent to which the control point deviates from the curve, and all $w_i>0$; $N_{i,k}(u)$ is a k-degree B spline basis function defined on an aperiodic and non-uniform node vector $U=\{a, \ldots, a, u_{k+1}, \ldots, u_{m-p-1}, b, \ldots, b\}$, having the number of m+1, wherein the number of a and b is k+1, and m=n+k+1; a=0, b=1; substituting the parametric equation into the envelope condition formula to obtain the following formula:

$$\phi_1 = -\int_0^u \frac{C_y(u)C_y' + C_x(u)C_x'(u)}{R_1 C_y(u)} dt + \phi_0,$$

$$\text{let } f(u) = \frac{C_y C_y'(u) + C_x(u)C_x'(u)}{C_y(u)}, \text{ then } \phi_1 = -\frac{1}{R_1}\int_0^u f(u)dt + \phi_0;$$

substituting numerical integration result of any point on the meshing line into the meshing condition relation to obtain a one-to-one mapping relation between rotor rotation angles and design parameters; and step 2.4, obtaining a male and female rotor profile equation corresponding to the meshing line of the NURBS spline curve segment using the meshing condition relation and the conversion relation between the male and female rotor coordinates and meshing line static coordinates simultaneously.

3. The method according to claim 2, wherein the f(u) is solved using Romberg quadrature formula:

$$T_m^{(k)} = \frac{4^m T_{m-1}^{(k+1)} - T_{m-1}^{(k)}}{4^m - 1} (m = 1, 2, \ldots, k = 0, 1, 2, \ldots),$$

where $$T_m^{(k)} = I_{m+1}\left(\frac{b-a}{2^k}\right); I = \int_a^b f(u)dx,$$

and interval [a,b] is equally divided into $2^k$ portions;

specific steps are as follows:

A, determining a corresponding integrand f(u) on the meshing line segment according to NURBS curve parameter equation, setting a=0 and b=u, and setting solution precision ε;

B, setting initial step size h=b−a, $$T_0^{(0)} = \frac{h}{2}[f(a) + f(b)]$$

and initializing k=1;

C, calculating an iterative formula and using the formula to calculate:

$$T_0^{(k)} = \frac{1}{2}\left[T_0^{(k-1)} + h\sum_{i=0}^{2^k-1} f\left(a + \left(i + \frac{1}{2}\right)h\right)\right], i = 0, 1, 2 \ldots 2^k - 1,$$

then calculating:

$$T_m^{(k-m)} = \frac{4^m T_{m-1}^{(k-m+1)} - T_{m-1}^{(k-m)}}{4^m - 1}, m = 1, 2, \ldots, k,$$

D, judging whether precision requirement is met by judging whether a difference between previous and late iteration results is smaller than a precision value, i.e., $|T_m^{(O)} - T_{m-1}^{(O)}| < \varepsilon$; if the requirement is met, stopping calculation and outputting $T_k^{(O)}$; if the requirement is not met, setting $$h = \frac{h}{2}, k = k + 1,$$

and then returning to step C;

wherein if a point on the meshing line segment is on the x axis, $C_y(u_0)=0$ and the point is a first type of discontinuity point of the function f(u); according to design requirement of the meshing line, a point passing through the x axis on the meshing line must satisfy $C_x(u_0)=0$ or $C_x'(u_0)=0$, and function value at this point is substituted with a limit value for solving; and it can be obtained using L'Hospital's rule:

$$f(u) = \begin{cases} \lim_{u \to u_0} \frac{C_x(u)C_x'(u) + C_y(u)C_y'(u)}{C_y(u)} = \frac{C_x'(u)C_x'(u)}{C_y'(u)} + C_y'(u), & C_x(u_0) = 0 \\ \lim_{u \to u_0} \frac{C_x(u)C_x'(u) + C_y(u)C_y'(u)}{C_y(u)} = \frac{C_x(u)C_x''(u)}{C_y'(u)} + C_y'(u), & C_x'(u_0) = 0 \end{cases}.$$

4. The method according to claim 3, wherein the step 3 is specifically: adjusting control vertexes of the eight functional segments af, $fo_0$, $o_0b$, bc, cd, $do_0$, $o_0e$ and ea of the meshing line respectively to observe corresponding changes of the rotor profile, or slightly adjusting the weight factor $w_i$ of the control point of the NURBS curve of each functional segment to control local curve variation of the meshing line, thereby adjusting rotor profile and observing changes in leak triangle, contact line length, inter-tooth area and area utilization coefficient.

5. A computer program product comprising a non-transitory computer readable medium having instructions recorded thereon, the instructions when executed by a computer implementing the method according to claim 1.

* * * * *